US005198665A

United States Patent [19]

Wells

[11] Patent Number: 5,198,665

[45] Date of Patent: Mar. 30, 1993

[54] QUADRUPOLE TRAP IMPROVED TECHNIQUE FOR ION ISOLATION

[75] Inventor: Gregory J. Wells, Fairfield, Calif.

[73] Assignee: Varian Associates, Inc., Palo Alto, Calif.

[21] Appl. No.: 890,990

[22] Filed: May 29, 1992

[51] Int. Cl.[5] ..... H01J 49/42

[52] U.S. Cl. ..... 250/282; 250/281; 250/291; 250/292

[58] Field of Search ..... 250/282, 281, 290, 291, 250/293, 292

[56] References Cited

U.S. PATENT DOCUMENTS

| | | | |
|---|---|---|---|
| 4,736,101 | 4/1988 | Syka et al. | 250/292 |
| 4,749,860 | 6/1988 | Kelley et al. | 250/282 |
| 4,761,545 | 8/1988 | Marshall et al. | 250/291 |
| 4,945,234 | 7/1990 | Goodman et al. | 250/291 |
| 4,990,856 | 2/1991 | Anderson et al. | 250/282 |
| 5,075,547 | 12/1991 | Johnson et al. | 250/282 |
| 5,128,542 | 7/1992 | Yates et al. | 250/282 |
| 5,134,286 | 7/1992 | Kelley | 250/282 |

*Primary Examiner*—P. M. Dzierzynski
*Assistant Examiner*—Kiet T. Nguyen
*Attorney, Agent, or Firm*—Gerald M. Fisher; Edward H. Berkowitz

[57] ABSTRACT

A method for isolating an ion in a QIT (1) employing values from a mass axis calibration chart to establish the maximum DAC value to scan to in order to scan out m(p)-1 and less during ramp up of RF trapping field while applying a specifically selected fixed supplemental frequency applied during said calibration; and employing values from the calibration curve to establish the DAC value to scan out m(p)+1 and greater during ramping down of RF trapping field, while applying a previously determined fixed broadband spectrum to the QIT end caps.

17 Claims, 4 Drawing Sheets (1) $B_Z = \left(a + \frac{q^2}{2}\right)^{1/2} = \frac{q}{\sqrt{2}}$ FOR $a=0$ (2) $B_Z = \left(\frac{q^2}{q^2-2} - \frac{7q^4}{96} + \frac{29q^6}{2304}\right)^{1/2}$ FOR $a=0$ (3) SUCESSIVE APPROXIMATION

QUADRUPOLE TRAP IMPROVED TECHNIQUE FOR ION ISOLATION

FIELD OF THE INVENTION

This invention relates to an improved method and apparatus for isolating an ion of interest in a quadrupole ion trap.

BACKGROUND OF THE INVENTION

The quadrupole ion trap (QIT) was first disclosed in the year 1952 in a paper by Paul, et al. This paper disclosed the QIT and the disclosure of a slightly different device which was called a quadrupole mass spectrometer (QMS). The quadrupole mass spectrometer was very different from all earlier mass spectrometers because it did not require the use of a magnet and because it employed radio frequency fields for enabling the separation of ions, i.e. performing mass analysis. Mass spectrometers are devices for making precise determination of the constituents of a material by providing separations of all the different masses in a sample according to their mass to charge ratio. The material to be analyzed is first dissociated/fragmented into ions which are charged atoms or molecularly bound groups of atoms.

The principle of the quadrupole mass spectrometer (QMS) relies on the fact within a specifically shaped structure radio frequency (RF) fields can be made to interact with a charged ion so that the resultant force on certain of the ions is a restoring force thereby causing those particles to oscillate about some reference position. In the quadrupole mass spectrometer, four long parallel electrodes, each having highly a precise hyperbolic cross sections, are connected together electrically. Both dc voltage, U, and an RF voltage, $V_0 \cos \omega t$, can be applied. When an ion is introduced or generated within the spectrometer, if the parameters of the quadrupole are appropriate to maintain the oscillation of those ions, such ions would travel with a constant velocity down the central axis of the electrodes at a constant velocity. Parameters of operation could be adjusted so that ions of selected mass to charge ratio, m/e, could be made to remain stable in the direction of travel while all other ions would be ejected from the axis. This QMS was capable of maintaining restoration forces in two directions only, so it became known as a transmission mass filter. The other device described in the above mentioned Paul, et al. paper has become known as the quadrupole ion trao (QIT). The QIT is capable of restoring forces on selected ions in all three directions. This is the reason that it is called a trap. Ions so trapped can be retained for relatively long periods of time which supports separation of masses and enables various important scientific experiments and industrial testing which can not be as conveniently accomplished in other spectrometers.

The QIT was only of laboratory interest until recent years when relatively convenient techniques evolved for use of the QIT in a mass spectrometer application. Specifically, methods are known for creating ions of an unknown sample after the sample was introduced into the QIT, and adjusting the QIT parameters so that it stores only a selectable range of ions from the sample within the QIT. Then by linearly changing, i.e., scanning, one of the QIT parameters it became possible to cause consecutive values of m/e of the stored ions to become successively unstable. The final step in a mass spectrometer was to sequentially pass the separated ions which had become unstable into a detector. The detected ion current signal intensity, as a function of the scan parameter, is the mass spectrum of the trapped ions.

U. S. Pat. No. 4,736,101 describes a quadrupole technique for performing an experiment called MS/MS. In U. S. Pat. No. 4,736,101, MS/MS is described as the steps of forming and storing ions having a range of masses in an ion trap, mass selecting among them to select an ion of particular mass to be studied (parent ion), disassociating the parent ion by collisions, and analyzing, i.e. separating and ejecting the fragments (daughter ions) to obtain a mass spectrum of the daughter ions. To isolate an ion for purposes of MS/MS the '101 patent discloses a method of scanning (ramping up) the RF trapping field voltage according to known equations to eject ions having atomic mass up to the m/e of ion of interest. Then, the RF trapping field voltage is lowered and the ions remaining are disassociated by collision. Finally, the RF trapping voltage is scanned up again and a mass spectrogram of the ejected daughter ions is obtained. One technique for obtaining collision induced disassociation (CID) to obtain daughter ions is to employ a second fixed frequency generator connected to the end plates of the QIT which frequency is at the calculated secular frequency of the retained ion being investigated. The secular frequency is the frequency in which the ion is periodically, physically moving within the RF trapping field.

The '101 patent also discloses use of a supplementary RF field voltage applied to the end cap electrodes of a QIT containing daughter ions while the RF trapping field is being scanned as a means of successively ejecting increasing mass ions to obtain a spectrum. In this instance, the patent employs a reduced maximum magnitude of the RF trapping field voltage.

The difficulty with the technique of the '101 patent is that after the ionization step, the parent ion, m(p), is selected for MS/MS using the so called mass instability method. This is where one of the quadrupole parameters, i.e. the RF field voltage, is varied to move the ions having M/e outside the range of interest into the instability region, i.e. $q_z > 0.908$. In the '101 patent this was accomplished by ramping up the RF trapping field voltage to cause those ions having M/e less than the selected parent ion, m(p), to be ejected. Ions of mass greater than m(p) are retained in the trap. The voltage level of the RF trapping field is then lowered and CID accomplished. This means that ions having greater than the M/e of the selected m(p) were present during CID. These ions can cause interference and/or unwanted reactions or daughter ions.

The problem of incomplete isolation in MS/MS of the parent m(p) ion is addressed in U. S. Pat. No. 4,749,860. In this prior patent, a second, supplemental RF field is applied to the end caps. The frequency of this supplemental RF field corresponds to the secular frequency of a specific ion having a M/e value which is one M/e unit greater than the selected parent ion, i.e. m(p)+1. The '860 patent applied this supplement RF field to the end caps simultaneously with the application of the ramping of the voltage of the RF trapping field to the ring electrodes. There are at least three problems with this '860 approach. First, the use of mass instability scanning to eject ions of mass less than m(p) suffers from poor mass resolution and thus results in significant loss in the intensity of the m(p) ion while attempting to completely move the m(p)−1 ion out of the stability region. Second, the stability boundary on the high side is flat so that this procedure also suffers significant loss of the m(p) ion when trying to eliminate the m(p)+1.

Finally, to use the '860 technique, it is essential to know the precise value of the trapping field operating on the ions in order to calculate the precise frequency to apply to the supplementary field. This precise frequency is difficult to know because of mechanical or electrical imperfections and because of space charge effects which act to significantly shift the stability region. The equation used to calculate the supplemental frequency which is given in the '860 patent is $W=\frac{1}{2}\beta_z W_o$, where $W_o$ is the frequency of the RF trap field.

The value $\beta_z$ is known to be defined by several approximating formulas, each of which are known to be accurate only for regions of the stability chart for lower values of the $q_z$. Accordingly, it has become common to apply the supplemental frequency to eliminate the high m(p)+1 values at low values of $q_z$ parameter. In this low $q_z$ region, the relationship between the mass and resonant frequency is non-linear and the resolution at usual scan speed is poor. Furthermore, there is a limit to the maximum mass which can be ejected by this technique. To increase the value of the RF field beyond this value will also eject the parent ion of interest. To reach these higher mass value ions, the '860 patent adds an additional step of frequency scanning the supplemental frequency downward to low frequencies. This frequency scanning technique requires complex equipment and also introduces undesirable additional process time into the isolation process.

U.S. Pat. No. 4,761,545 discloses a technique called tailored excitation ion spectroscopy for employing Fourier synthesized excitation to create a time domain excitation waveform to cause tailored ejection of specific bands or ranges of ions. As pointed out in the '545 patent, the tailored FT method requires an extremely high power amplifier with high voltage output unless phase scrambling is employed. U.S. Pat. No. 4,945,234 discloses that phase scrambling distorts the excitation spectrum so that it is not possible to achieve arbitrary excitation frequency spectra at suitable low peak excitation voltages at the same time and that corrections are required for certain so called Gibbs oscillations. FT tailored excitation requires very expensive computational and RF synthesization equipment in order to be capable of tailoring to any desired frequency components.

SUMMARY OF THE INVENTION

It is an object of this invention to provide an improved method for isolating an ion, particularly useful for MS/MS requiring simpler and less expensive equipment.

It is a further object to provide ion isolation methods and apparatus having high resolution, permitting isolation of a parent ion without loss of the parent ion intensity.

It is a feature of my invention that it uses a calibration of the mass axis of the trap along with specifically selected supplemental generator frequencies to eject ions above and below the selected ion.

It is a feature of my invention that my method employs a single, specifically fixed frequency supplemental field which is used to efficiently eject all ions of lower mass number than m(p) without requiring calculations by the user of the secular frequency for each m(p).

It is a further feature of my invention that it employs a broad band generator having a fixed spectra for resonance ejection of all ions having mass numbers greater than m(p).

BRIEF GENERAL DESCRIPTION OF THE INVENTION

Figure 1:
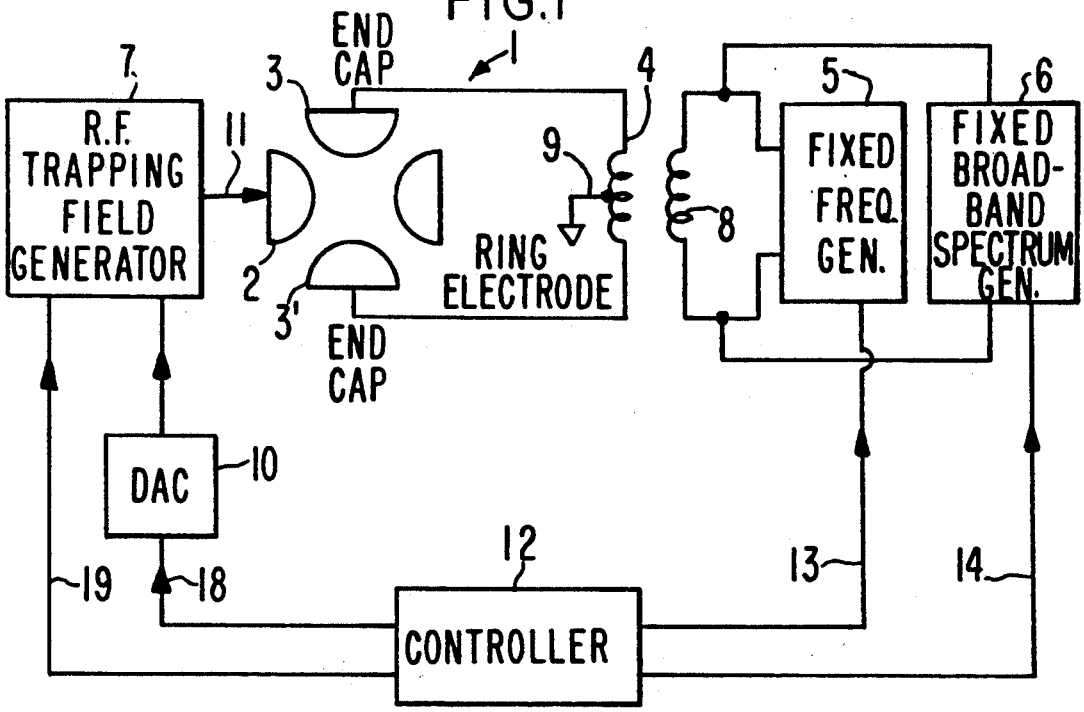
FIG. 1 is a block diagram of novel system.

I have devised a technique using an empirical calibration procedure combined with one of the known techniques for sequentially scanning ions out of a QIT to precisely eject all ions up to and including the ion one atomic mass units, that is m(p)−1, less than the ion mass m(p) which is selected to be isolated. My technique exhibits both efficiency and high resolution so that substantially no m(p) ions are lost when ejecting the m(p)−1 ions using my procedure. This can be critical when the selected ion is very low concentration.

As described in U.S. Pat. No. 4,736,101, a supplemental oscillator at a fixed frequency connected to the end caps of a QIT will sequentially resonantly eject ions from the QIT to a detector when the RF trap field voltage is scanned upward according to a linear ramping function of time. The RF scanning also produces scanning of the secular frequencies of each ion species in the QIT and when that secular frequency matches the frequency of the supplementary oscillator, the particular species will resonantly absorb energy and become ejected from the trap.

I have discovered a novel way to use this previously known sequential QIT ejection processes and the known mass calibration procedure to precisely and efficiently eject the ions up to and including the ion one atomic mass unit, less than e.g., m(p)−1, a selected parent ion m(p) which parent is previously selected for isolation storage in the QIT.

First, I use a particularly selected supplemental fixed frequency. The selection process will be explained subsequently.

Second, as known in the art, I establish the calibration curve for the particular QIT to create a precise empirical relationship between the setting of the digital to analogue converter (DAC) 10 for the RF trapping voltage and the mass of the ion which is resonantly ejected and detected at the selected fixed supplemental field for the particular values of DAC setting, i.e. RF trapping field. The calibration curve is established using a calibration gas (PFTBA) which has masses at well known values distributed across the mass regions of interest.

After obtaining the calibration, one is prepared to run the experiment and to eliminate all ions of an ionized sample of m/e less than and including m(p)−1. From the calibration chart prepared above, I can now selected the value of the DAC which will cause ejection of any selected m/e value. Since I know the parent ion, m(p), that I wish to isolate, I ramp the DAC value up to the value for the DAC from the calibration curve for the m(p)−1 ion while the supplemental generator is enabled at the selected frequency for which the calibration curves were developed.

When the RF storage field potential 11 is ramped up to the m(p)−1 value commanded by the value of the DAC set in the above step, this will cause ejection of ions m(p)−1 and lower mass, and leave remaining all ions m(p) and greater in the trap.

My technique for selecting the fixed supplemental frequency to be used above is important. It can be shown that any frequency can be selected as the supplemental frequency and as the RF voltage is ramped, the various masses will increase in value of q until their secular frequency equals the supplemental frequency resulting in ejection. However, the resolution, i.e., ability to selectively resonant one ion value m/e without exciting m/e+1, depends on the number of cycles of the supplemental field that the ion experiences during the excitation process. Accordingly, at a given scan rate, dv/dt, it follows that the maximum number of cycles of interaction will be obtained at the maximum frequency of the supplemental field.

The maximum limit of the secular frequency occurs when $\beta_z=1$. This is where $q_z=0.908$ which is the stability boundary for all the ions. In practice, I have discovered an undesirable beat phenomena occurs, when $\beta_z=1$. Accordingly, the actual supplemental frequency is selected to be somewhat less than ½ the trapping frequency. I have found that $\beta_z=0.923$ results is no beating and provides good resolution at reasonable scan speeds.

The next steps in my procedure to isolate the selected m/e ion in the QIT is to remove the ions having m/e values greater than the selected ion.

At the previously calibrated value of the RF field voltage, $V_{m-1}$ for which the m(p)−1 ion was ejected, there will be the corresponding calibrated value of q for those ions of m/e greater than m(p)−1. In general, for $V_{m-1}$ there are masses (m+i) and corresponding $(q_{m+i})$ and thus $(\beta_{m+i})$ and $(W_{m+i})$ for all such masses. Since (m+1) ion is close to the m−1 ion for which the relationship between RF trapping field voltage (and thus DAC value) and mass had been established by calibration, the relationship between the secular resonant frequencies can be expressed as $W_{m+1}=W_{m-1}+\Delta W$. I have discovered that this expression is independent of the exact value of m/e in the regions for which the mass axis has been calibrated. Accordingly, once the resonance frequency corresponding to (m+1) is found by calibration at any mass (m), the system is piecewise calibrated exactly at all masses (m+i) displaced from a mass m for which the mass axis had been calibrated.

In theory, it is possible to determine ΔW and calibrate the (m+1) ion resonance by varying the frequency, but it is more straight forward and easier to first fix the frequency of the supplemental field at a value corresponding to ion (m+j) for $V_{m-1}$ where j=2, 3 or 4.

Then, the trapping field is iteratively decremented, i.e., scanned down, by a small value (ΔV) until the ion m+1 is observed to disappear. The final calibrated value of the trapping field is thus $V=V_{m-1}-\Delta V$.

While the value of ΔV could be determined for each calibration ion that was used to create the piecewise linear calibration curve, in practice the same offset has been found adequate for most all mass values.

The commonly used calibration gas in PFTBA (perfluorotribulylamine) since it has several well known intense ions at masses from 31 up to 614 and each has an isotope at (m+1). Thus the nearby major ion can be used for calibration of the mass axis and the isotope is ion at (m+1) can be used for determining the trapping field offset voltage (ΔV).

This procedure provides the precise control required to resonantly eject (m+1), ions without loss of the selected parent ion (m). To eject any other ion of m/e greater than (m+1) does not require as much care. By providing a plurality of frequencies in a composite broadband waveform when the frequencies are spaced less than the width of the ion resonance, the remaining ions can be ejected. If the trapping voltage offset begins, as described above, at a value less than ΔV and increases to ΔV, then all the resonant frequencies corresponding to higher masses will be swept by the frequencies that are in the composite waveform. The scanning reduces the need to have the frequency spacing in the broadband waveform less than the width of the resonance.

DETAILED DESCRIPTION OF THE INVENTION

With reference to FIG. 1, the quadrupole ion trap 1 employing a ring electrode 2 of hyperbolic configuration is shown connected to a radio frequency trapping field generator 7. The digital-to-analogue converter (DAC) 10 is connected to the RF trapping field generator 7 for controlling the amplitude of the output voltage 11. In this schematic, the hyperbolic end caps 3 and 3' are connected to winding 4 of a coupling transformer 8 having a center tap 9 connected to ground. The transformer 8 secondary winding is connected to a fixed frequency generator 5 and to a fixed broadband spectrum generator 6. Controller 12 is connected to DAC 10 via connector 18 and the three generators 5, 6 and 7 via connectors 13, 14 and 19 respectively to manage the timing of the QIT sequences.

Figure 2:
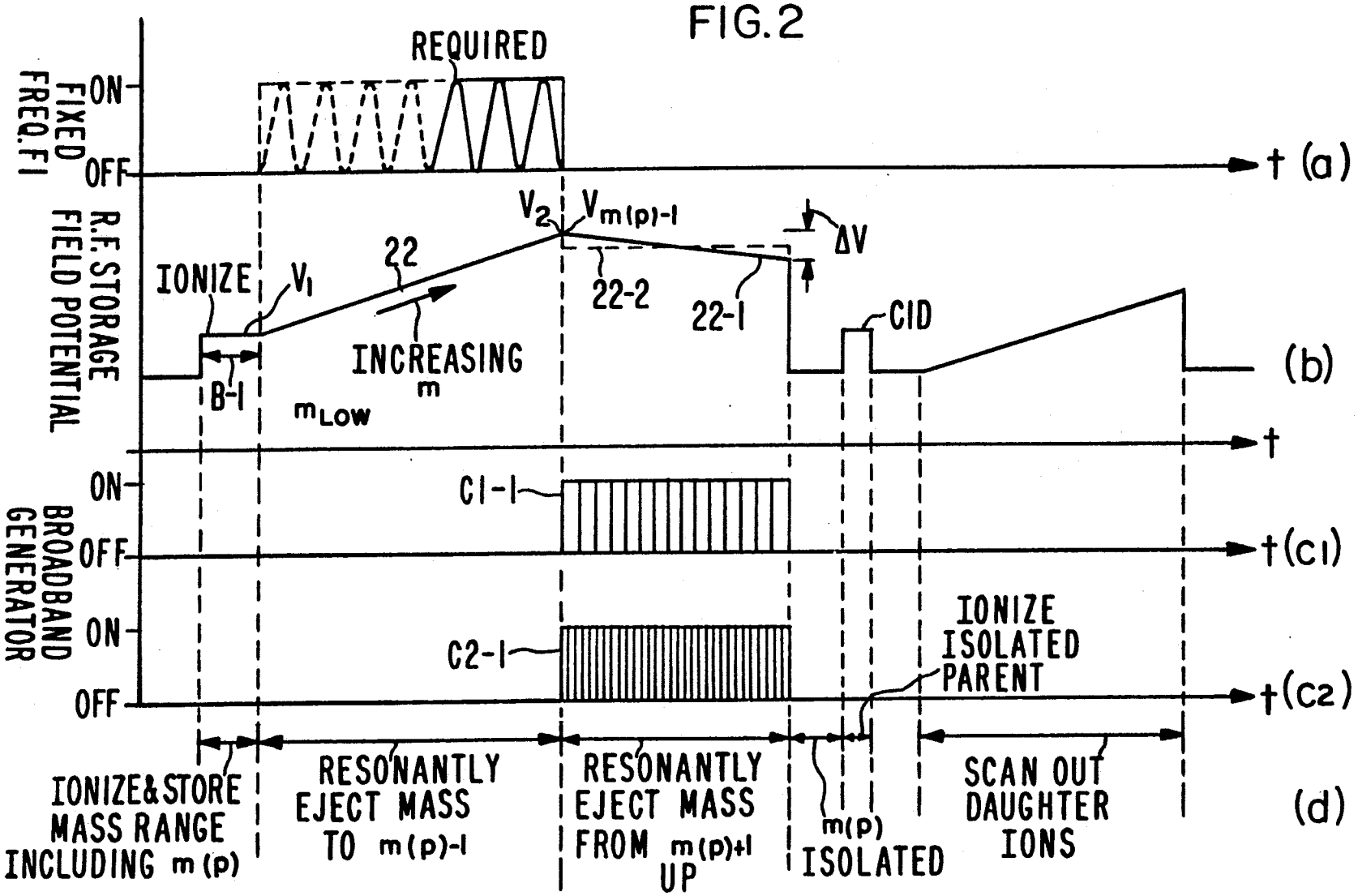
FIG. 2 is a scanning time sequence according to my invention.

With reference to FIG. 2 timing diagrams, the inventive method of using the apparatus of FIG. 1 is described. In FIG. 2(*b*), there is shown the RF trapping field waveform 11 representative of the change as a function of time of the RF storage field potential output (v) of the trapping field RF generator (7) used as part of the process to isolate a selected parent ion of mass/charge ratio m(p). The sample material to be analyzed is introduced into the trap and caused to be ionized in the trap by electron impact or chemical ionization by ionization apparatus (not shown). The ionization takes place during the time B−1, FIG. 2(*b*), during which time the RF voltage (v) is raised a small amount to a voltage level $V_1$, selected to cause the trap to store a selected range of masses including m(p), as will be explained subsequently. Immediately after ionization, the RF trapping field is ramped from $V_1$ to $V_2$. During at least a portion of the ramping time, the fixed frequency generator 5 is turned on, FIG. 2(*a*), to induce resonant ejection of all the ions of mass/charge ratio less than and including m(p)−1. As stated earlier, the frequency of generator 5 should be slightly less than ½ the frequency of RF trapping field generator 7. It was known in the prior art to ramp increase the RF trapping field to sequentially eject, in ascending order the low mass to high mass ions by the so called destabilizing technique known as mass instability scanning. In my method, in addition to the RF trapping field ramp, I simultaneously apply a fixed frequency to the end caps equal to approximately ½ the RF trapping field frequency as the RF voltage supplemental frequency from generator 5 to resonant with the secular frequency of the ions.

In my invention, after calibration of the mass axis of the QIT is completed, no calculations are necessary to determine the secular frequency and the fixed frequency generator 5 does not need to be adjusted in frequency during an experiment. In fact, the fixed frequency generator 5 should be set at approximately 485.0 KHz for and RF Trapping frequency of 1.05 MHz. This single fixed frequency RF generator can be used for ejection of ions m(p)−1 for all m(p) up to greater than 700. This significantly simplifies both the quadrupole apparatus and the method of using such apparatus.

According to the theory, for a fixed radius trap operating at a fixed RF frequency, F, the relationship of the RF trapping field voltage, V, the mass/charge ratio and the parameter $q_z$ are related as follows:

$$q_z = -4\frac{eV}{mr_0^2F^2} = \frac{KV}{m} \quad (1)$$

For a device where $r=1\times10^{-2}$ meters and F=1.0 MHz $$q_z = 0.0978\frac{V}{m} \quad (2)$$

where m is in atomic mass units and V is in volts.

The equation to determine the secular frequency of resonance is:

$$W_s = \beta_z\frac{F}{2} \quad (3)$$

Figure 4:
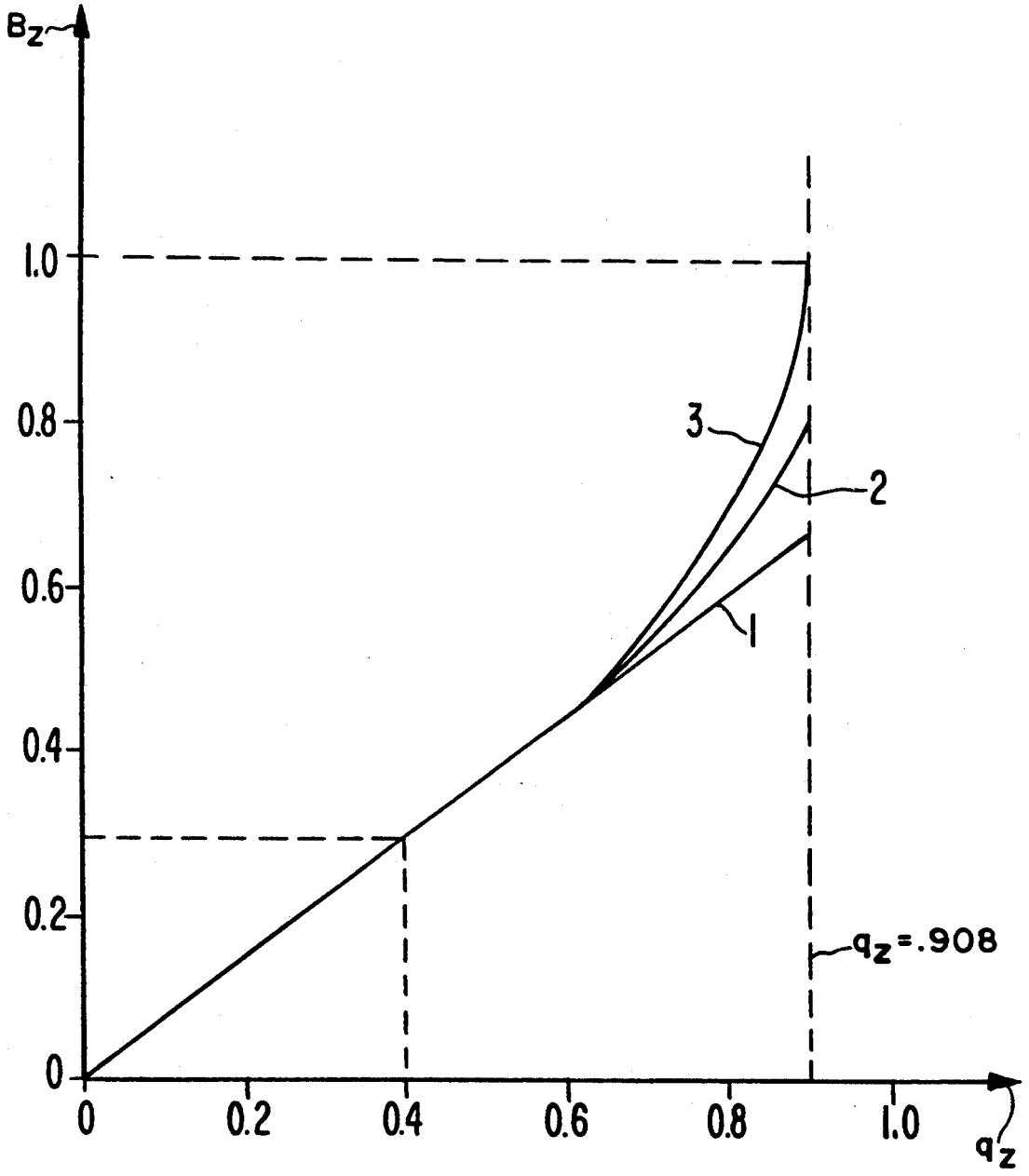
FIG. 4 is graph of $\beta_z$ vs. $q_z$.

FIG. 4 illustrates the relationship between the parameter $\beta_z$ and $q_z$. There are several approximating equations which have been used to relate $\beta_z$ to $q_z$, as shown in FIG. 4. Equation (1) FIG. 4 is accurate for $q_z<0.4$. Equation (2) FIG. 4 is accurate for $q_z<0.6$. Equation (3), is derived by the method of successive approximations and is accurate in the region near $q_z=0.9$. At $q_z=0.908$, it is known that theoretically $\beta_z=1$. The relationship between $\beta_z$ and $q_z$ is highly significant in the context of this invention. Until my invention, one needed to determine the secular resonance frequency for any ion to be ejected by calculation. In order to determine the secular frequency for exciting a particular ion, one needed to first determined the precise value of $\beta_z$. However, even without considering the shifts due to space charge or mechanical effects, it is extremely difficult to determine $\beta_z$ theoretically near q=0.908.

Equations (1), (3) and those equations on FIG. 4, show the relationship between the fundamental parameters of the trap and the secular resonant frequencies. For a given value of q from equation (1), it can be seen that by increasing V, sequential values of M are brought to the same value of q. From equation (3), the resonant frequency $W_s$ of the ion depend on $\beta$ and $\beta$ is also a function of q. Thus by choosing a value of the supplemental frequency $W_s$ applied to the end caps and by ramping V, the various masses will increase in their of q and $W_s$ until $W_s$ equals the supplemental frequency and the ion absorbs energy and is ejected.

Figure 3:
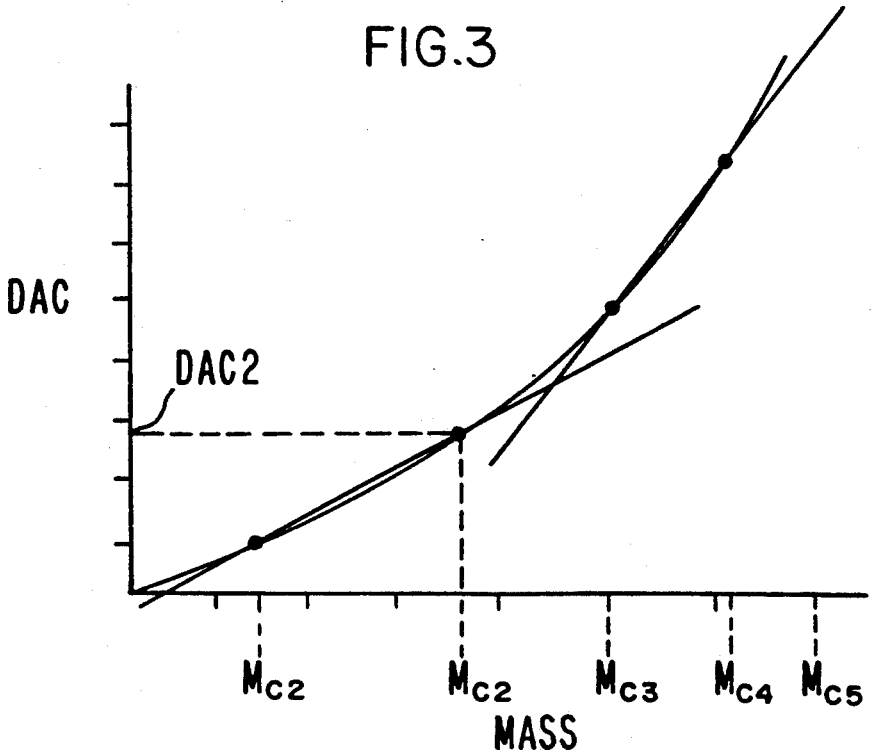
FIG. 3 is typical mass axis calibration curve.

The mass axis has been calibrated as shown in FIG. 3 for a fixed value of supplemental frequency. Ideally, m is linearly related to V and to the DAC control value. Using a calibration gas (PFTBA) with masses at well known values distributed across the mass range of interest, a piecewise linear calibration curve is determined between the DAC value and the mass of the ion that is resonantly rejected for the fixed supplemental field. This curve establishes the DAC values to bring a given mass into resonance with the fixed supplemental field. With the mass axis calibration established for resonance ejection, to isolate any particular mass (m), i.e. mc3, FIG. 3 within the calibrated range, the DAC value corresponding to the mass (m−1), i.e., DAC 2 for mc2 is taken from the calibration curve and set into the DAC 10 (FIG. 1) as the maximum value of the RF voltage ramp during portion 22, FIG. 2(*b*). As the RF voltage 11 ramps up, the ions up to and including (m−1), i.e., mc2 are ejected from the trap.

It is next necessary to eject those ions having mass numbers greater than m(p). To eject those ions near m(p), I use a similar concept. I determine another calibration for the QIT. By setting the frequency of the supplemental frequency generator connected to the end caps to a value corresponding approximately to the secular frequency for one of the close ions, (m+j), where j=1, 2 or 3 for the same value of maximum DAC used earlier to eject (m−1), and by decrementing RF trap voltage (DAC) until the ion at m+1 is ejected, I can calibrate the value ΔV or ΔDAC to eject the m+1 ion. I have determined that ΔDAC so determined is adequate for all values of mass to eject the (m+1) ion.

In my preferred procedure, when the supplemental broadband generator 6 waveform which includes composite frequencies, one of which is the secular frequency for resonating (m+j), is exciting the QIT and by ramping the RF field voltage the amount ΔV, down, i.e., decrementing the DAC to the previously calibrated value ΔV, those ions (m+j) to (m+1) will be ejected. As shown in FIG. 2(*c*1), a broadband supplementary AC field supplied by broadband frequency generator 6 is switched on and applied to the trap end caps. This field corresponds to frequencies for resonance of m(p)+3 in the range of 420–460 KHz down to 10–20 KHz for masses 600–700.

The broadband frequency distribution could be a series of discrete frequencies equally spaced as in FIG. 2(*c*1) or can be continuous as in FIG. 2(*c*2), or it could be non-uniformly spaced in the frequency domain.

Alternatively, the ejection of ions m(p)+1 and greater could be effected by using a fixed supplemental generator waveform which contains a discrete collection of frequencies which are spaced apart less than the width of the ion secular resonance, or a continuum of frequency as depicted in FIG. 2(*c*2) such as would be obtained by filtering random noise with a low pass filter so as to provide a sharp frequency cut-off at the desired frequency, corresponding to M+1. For these closely spaced supplemental frequencies, the RF trapping field could remain at a constant value as depicted by 22-2 in the waveform of the RF storage field potential, FIG. 2(*b*).

Figure 5:
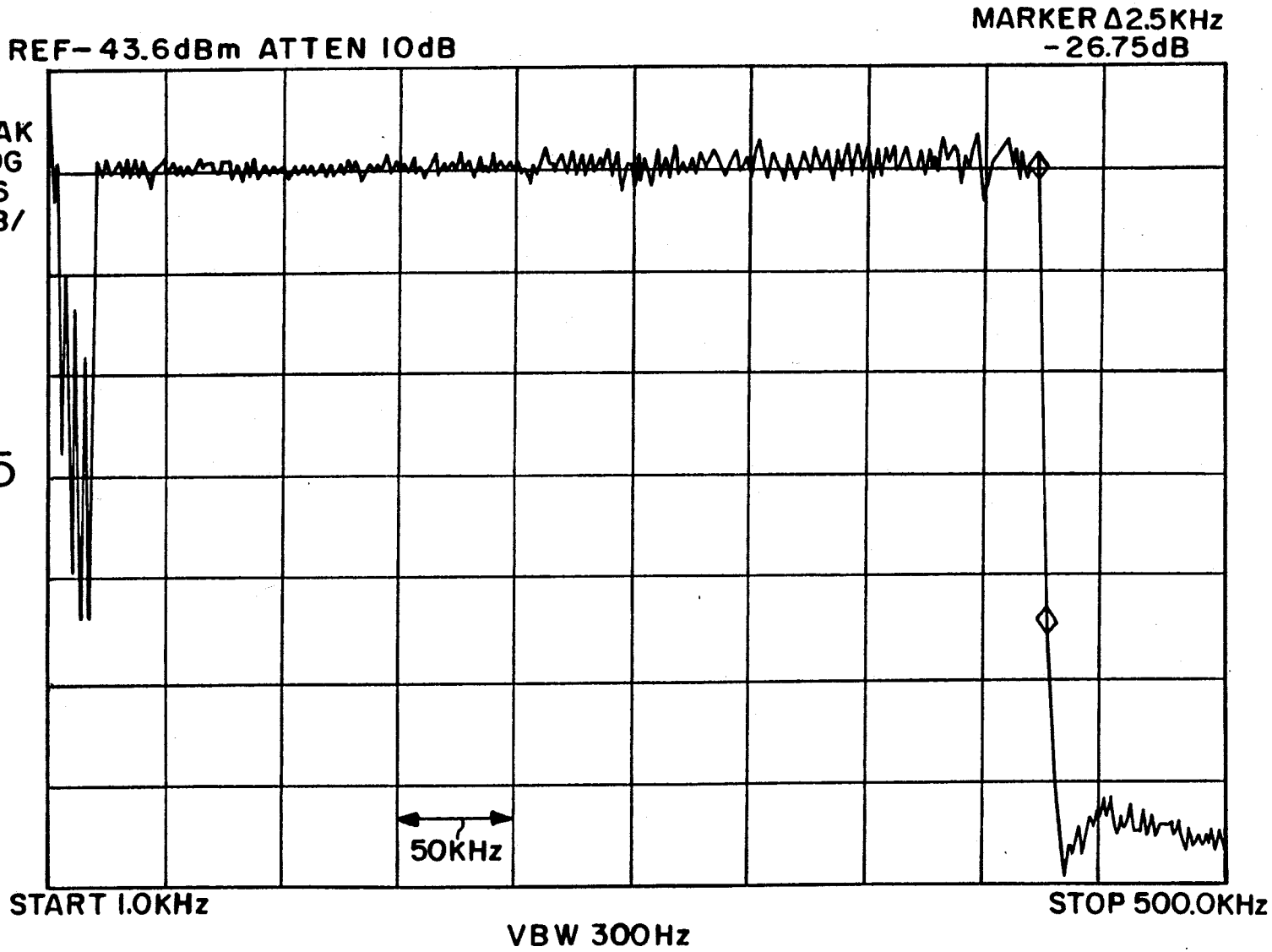
FIG. 5 is the output time domain waveform of the preferred. Fixed Broadband Spectrum Generator of FIG. 1.

FIG. 5 is a frequency spectrum of the broadband waveform of generator 6 which has been used to resonantly eject all the ions of mass number greater than m(p)+1. This spectrum was created by summing 1000 discrete frequencies, between 20 KHZ and 420 KHZ, that were equally spaced with their phases calculated by a random number generator. The cut-off at high frequencies in the frequency spectrum is very sharp, such as −26 db in 2.5 KHz. Alternatively, the broadband waveform could be obtained by means of digitally filtered noise which contains no gaps or notches in the frequency spectrum created. Additionally, as described in combination with the ramping down voltage of FIG. 2(*b*), 22-1, the ensemble of frequencies could be wider apart than the width of the resonance line, FIG. 2(*c*1) because the RF trapping fields voltage is decremented which causes the intermediate ions to come into resonance with the applied frequencies.

The invention herein has been described with respect to specific figures. It is not my intention to limit my invention to any specific embodiment, but the scope of my invention should be determined by my claims. With this in view,

What is claimed is:

1. In a method for isolating a selected parent ion having a mass m(p) for MS/MS spectroscopy employing a quadrupole ion trap (QIT) system, said QIT system having a ring electrode, a pair of end caps, an RF trapping voltage source having a trapping frequency F connected to said ring electrode, and supplementary RF voltage generator sources connected to said end caps, said method for isolating a selected parent ion including:

(a) establishing said RF trapping voltage at a low value to enable retention of a large mass range of ions in said ion trap;

(b) ionization of a sample in said QIT;

(c) establishing said end caps at a zero DC voltage differential;

(d) ramping up said RF trapping voltage to eject ions;

(e) applying a broadband spectrum RF with a first supplementary RF generator to said end caps to resonantly reject those ions having masses greater than m(p);

(f) reducing said RF trapping voltage to a value to trap daughter ions, if any, produced by disassociation of said parent ion;

THE IMPROVED METHOD COMPRISING:

applying a fixed frequency supplemental excitation to said end caps during at least a portion of the time of step (d).

2. The method of claim 1 wherein the maximum ramping voltage during step (d) is selected from a calibration curve to eject m(p)−1 ion.

3. the method of claim 2 wherein said fixed frequency supplemental excitation is selected to have a frequency which is approximately ½ F.

4. The method of claim 2 wherein said fixed frequency substantially equals 0.923 F/2.

5. The method of claim 2 wherein the step of applying a broadband spectrum RF to said end caps includes applying a time domain waveform made up of a broadband spectrum of frequencies, said spectrum of frequencies including frequencies close to ½ F, each frequency in said frequencies having been selected to have random phase relation to the other of said frequencies of said spectrum of frequencies.

6. The method of claim 5 wherein the step of applying a broadband spectrum RF to said ends caps includes a frequency spectrum containing the addition of frequencies from 20 KHz to 420 KHz at frequency differences greater than the width of ion secular resonances.

7. The method of claim 6 whereas during step (e), the RF trapping voltage is ramped down by a calibrated value ΔV to eject all ions from m(p)+1 and greater.

8. The method of claim 1 wherein said at least a portion of the time of step (d) coincides with the peak of said ramping voltage.

9. In a method for isolating a selected parent ion having a mass m(p) for MS/MS spectroscopy employing a quadrupole ion trap (QIT) system, said QIT system having a ring electrode, a pair of end caps, an RF trapping voltage source having a trapping frequency F connected to said ring electrode, a first supplementary voltage generator source connected to said end caps, and a second supplementary voltage generator source connected to said end caps, said method for isolating a selected parent ion including:

(a) establishing said RF trapping voltage at a low value to enable retention of a large mass range of ions in said ion trap;

(b) ionization of a sample in said QIT;

(c) establishing said end caps at a zero DC voltage differential;

(d) ramping up said RF trapping voltage;

(e) applying a broadband spectrum RF with said first supplementary RF generator to said end caps to resonantly reject those ions having masses greater than m(p);

(f) reducing said RF trapping voltage to a value to trap daughter ions, if any, produced from disassociation of said parent ion;

THE IMPROVED METHOD COMPRISING:

said step of applying a broadband spectrum of RF to said end caps includes applying a predetermined, broadband spectrum of frequencies, said spectrum of frequencies including frequencies up to approximately one half of the RF trapping frequency F.

10. The method of claim 9 wherein said broadband spectrum includes the addition of frequencies of equal amplitude from 20 KHz to 420 KHz with the phase of each of said frequency being selected randomly.

11. The method of claim 10 wherein said step of applying a broadband spectrum RF to said end caps includes the step of reducing the said RF storage field voltage by an amount ΔV determined by calibration.

12. The method of claim 11 wherein a fixed frequency supplemental excitation is applied to said end caps simultaneously with at least a portion of the period of time of step (d) ramping of said RF trapping voltage.

13. The method of claim 12 wherein the said fixed frequency supplemental excitation is selected to substantially satisfy the equation $W_s=0.923^* F/2$, where F equals the RF trapping frequency.

14. In a quadrupole ion trap system having a ring electrode, a pair of end caps, an RF trapping generator, first and second supplemental ion excitation generators, means to couple said first and second supplementary ion excitation generator sources to said end caps, and means coupling said RF trapping generator to said ring electrode,

THE IMPROVEMENT COMPRISING:

said first supplementary excitation source is a fixed frequency generator which fixed frequency of said fixed frequency generator is approximately (F/2) where F, is the frequency of said RF trapping generator.

15. The system of claim 14 wherein said fixed frequency generator is selected to satisfy the relationship $W_s=0.923^* (F/2)$ where F is the RF trapping frequency and $W_s$ is the frequency of the fixed frequency generator.

16. The system of claim 15 wherein said second supplement ion excitation source is a broadband source having a frequency spectrum containing the co-addition of frequencies of equal amplitude from 20 KHZ to substantially, (F/2) each said frequency having a phase which is randomly selected.

17. In a QIT system having a ring electrode, an RF trapping generator, first and second supplemental ion excitation generators, means to couple said first and second supplemental ion excitation generators to said end caps, and means coupling said RF trapping generator to said ring electrode,

THE IMPROVEMENT COMPRISING:

said second supplemental excitation ion generator being a broadband frequency source having a frequency spectrum from 20 KHz to substantially (F/2), said spectrum comprised of equal amplitude, equally spaced frequencies having random phases, where F equals, in operation, the RF frequency of said RF trapping generator.

* * * * *